US008072133B2

(12) United States Patent
Yamazaki et al.

(10) Patent No.: US 8,072,133 B2
(45) Date of Patent: Dec. 6, 2011

(54) LIGHT EMITTER SUBSTRATE AND IMAGE DISPLAYING APPARATUS USING THE SAME

(75) Inventors: Koji Yamazaki, Ayase (JP); Takashi Date, Machida (JP); Yukihiro Inoue, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 12/476,532

(22) Filed: Jun. 2, 2009

(65) Prior Publication Data

US 2009/0302735 A1 Dec. 10, 2009

(30) Foreign Application Priority Data

Jun. 9, 2008 (JP) ..... 2008-150427

(51) Int. Cl.
*H01J 1/62* (2006.01)
*H01J 31/12* (2006.01)

(52) U.S. Cl. ..... 313/496; 313/495; 313/497

(58) Field of Classification Search ..... 313/496
See application file for complete search history.

(56) References Cited

U.S. PATENT DOCUMENTS

| | | | | |
|---|---|---|---|---|
| 5,592,056 | A * | 1/1997 | Peyre et al. | 315/169.1 |
| 5,592,206 | A | 1/1997 | Watanabe et al. | |
| 5,986,399 | A | 11/1999 | Van Veen et al. | |
| 6,069,599 | A | 5/2000 | Py et al. | |
| 6,509,691 | B2 | 1/2003 | Yamazaki et al. | 315/169.3 |
| 6,853,148 | B2 | 2/2005 | Yamazaki et al. | 315/169.3 |
| 7,053,537 | B2 | 5/2006 | Hiroike et al. | 313/292 |
| 7,247,981 | B2 | 7/2007 | Yamazaki | 313/497 |
| 7,391,149 | B2 | 6/2008 | Yamazaki et al. | 313/495 |
| 7,400,082 | B2 | 7/2008 | Suzuki et al. | 313/473 |
| 7,537,503 | B2 | 5/2009 | Hiroike et al. | 445/24 |
| 7,808,171 | B2 * | 10/2010 | Sato et al. | 313/496 |
| 2003/0117081 | A1 | 6/2003 | Kasano | |
| 2005/0179398 | A1 | 8/2005 | Onishi | |
| 2006/0103294 | A1 | 5/2006 | Suzuki et al. | 313/496 |
| 2007/0257599 | A1 * | 11/2007 | Sato et al. | 313/495 |
| 2008/0157666 | A1 | 7/2008 | Date et al. | 313/506 |

(Continued)

FOREIGN PATENT DOCUMENTS

EP 0 635 865 1/1995

(Continued)

OTHER PUBLICATIONS

European Office Action 59299 dated Nov. 26, 2009.

(Continued)

*Primary Examiner* — Sikha Roy
(74) *Attorney, Agent, or Firm* — Fitzpatrick, Cella, Harper & Scinto

(57) ABSTRACT

It aims to improve, in a light emitter substrate which has a resistor for connecting electrodes adjacent in a row direction, withstand discharge performance of the resistor. In the light emitter substrate which comprises a substrate, plural light-emitting members which are positioned in matrix on the substrate, plural electrodes each of which covers at least one of the light-emitting members and which are positioned in matrix, and a row-direction resistor which is positioned between the electrodes adjacent in the row direction and connects these electrodes to each other, a row-direction separated distance Gx' between the electrodes adjacent in the row direction at a connecting portion between the electrodes and the row-direction resistor is larger than a row-direction separated distance Gx between the electrodes adjacent in the row direction at a portion covering the light-emitting members (Gx'>Gx).

2 Claims, 5 Drawing Sheets

U.S. PATENT DOCUMENTS

| | | | | |
|---|---|---|---|---|
| 2009/0160313 | A1 | 6/2009 | Yamazaki et al. | 313/495 |
| 2009/0184658 | A1 | 7/2009 | Inoue et al. | 315/291 |
| 2009/0309480 | A1 | 12/2009 | Inoue | 313/473 |
| 2009/0310360 | A1 | 12/2009 | Inoue | 362/249.01 |
| 2010/0001630 | A1 | 1/2010 | Yamazaki | 313/495 |

FOREIGN PATENT DOCUMENTS

| | | | |
|---|---|---|---|
| EP | 1 032 017 | A1 | 8/2000 |
| EP | 1 681 704 | A1 | 7/2006 |
| EP | 1 830 379 | A1 | 9/2007 |
| EP | 1 830 380 | A1 | 9/2007 |
| JP | 57-60644 | A | 4/1982 |
| JP | 60-195852 | A | 10/1985 |
| JP | 6--264028 | A | 12/1985 |
| JP | 60-264028 | A | 12/1985 |
| JP | 2006-173094 | A | 6/2006 |
| JP | 2006-185632 | A | 7/2006 |
| WO | 96/00977 | | 1/1996 |

OTHER PUBLICATIONS

European Patent Office Communication dated Apr. 29, 2011 (5 pages).

* cited by examiner

LIGHT EMITTER SUBSTRATE AND IMAGE DISPLAYING APPARATUS USING THE SAME

BACKGROUND OF THE INVENTION

1. Field of the Invention

The present invention relates to a light emitter substrate and an image displaying apparatus which uses the light emitter substrate.

2. Description of the Related Art

Conventionally, an image displaying apparatus which comprises an electron source substrate having plural electron-emitting devices arranged in matrix and a light emitter substrate having plural light-emitting members arranged in matrix and opposed to the plural electron-emitting devices has been known. In the image displaying apparatus like this, the light emitter substrate and the electron source substrate are typically opposed to each other at a gap of about several millimeters, and high voltage of, e.g., approximately 10 kV is applied between these substrates. For these reasons, a discharge occurs easily, and, if the discharge once occurs, a discharging current flows from the whole of a metal back which has been integrally formed, whereby an influence to the electron-emitting devices expands.

Consequently, in order to allow the image displaying apparatus of the above type to have a discharging current control function, Japanese Patent Application Laid-Open No. 2006-173094 corresponding to U.S. Patent Publication No. 2006/0103294 and Japanese Patent Application Laid-Open No. 2006-185632 corresponding to European Patent Publication No. 1830379A1 respectively disclose techniques for controlling a discharging current by two-dimensionally dividing a metal back and establishing a connection between the divided metal backs by a resistor.

However, if a discharge occurs in a case where further high voltage is applied to improve luminance, a potential difference between the adjacent metal backs increases, whereby there is a possibility that a secondary discharge occurs between the adjacent metal backs. Besides, if the resistor is arranged between the adjacent metal backs, discharge voltage of a material of the resistor is lower than surface discharge voltage between the metal backs according to a kind of the relevant material, whereby there is a possibility that withstand discharge structure is destroyed. In particular, in an ordinary image displaying apparatus to be used for a TV monitor, since a distance between the metal backs adjacent in a horizontal direction (=a row direction) is small, the secondary discharge occurs easily. If the secondary discharge occurs, the discharging current increases, whereby there is a possibility that a damage such as device destruction or the like which is not preferable for image displaying occurs.

To cope with such a problem as described above, in Japanese Patent Application Laid-Open Nos. 2006-173094 and 2006-185632, it is designed to define resistance in the row direction without arranging any resistor between light-emitting members adjacent in the row direction. More specifically, Japanese Patent Application Laid-Open No. 2006-173094 discloses the structure that the metal back divided in matrix and the resistors patterned in matrix are combined, and any resistor is not arranged between the metal backs adjacent in the row direction. Further, Japanese Patent Application Laid-Open No. 2006-185632 discloses the structure that the metal backs divided in matrix and striped resistors expanding in the row direction between the metal backs adjacent in a column direction are connected on the column side of the light-emitting members.

However, in the light emitter substrate disclosed in Japanese Patent Application Laid-Open No. 2006-173094, further improvement is desired in the points of definition of the resistance of the resistor and the discharge voltage of the material. Also, in the light emitter substrate disclosed in Japanese Patent Application Laid-Open No. 2006-185632, structure of further weakening field intensity applied to the resistor by controlling the secondary discharge between the metal backs adjacent in the row direction is desired.

SUMMARY OF THE INVENTION

The present invention aims to improve, in a light emitter substrate which has a resistor for connecting electrodes adjacent in a row direction, withstand discharge performance of the resistor. Moreover, the present invention aims to provide an image displaying apparatus which uses the light emitter substrate like this.

A light emitter substrate according to the present invention comprises a substrate, plural light-emitting members which are positioned in matrix on the substrate, plural electrodes each of which covers at least one of the light-emitting members and which are positioned in matrix, and a row-direction resistor which is positioned between the electrodes adjacent to each other in a row direction and connects these electrodes to each other. The light emitter substrate is characterized in that a row-direction separated distance between the electrodes adjacent to each other in the row direction at a connecting portion between the electrodes and the row-direction resistor is larger than a row-direction separated distance between the electrodes adjacent to each other in the row direction at a portion covering the light-emitting members.

Moreover, an image displaying apparatus according to the present invention comprises: an electron source substrate having plural electron-emitting devices; and the above-described light emitter substrate, wherein the light-emitting members of the light emitter substrate emit light in response to electrons emitted from the electron-emitting devices.

According to the present invention, in the light emitter substrate which has the resistor for connecting the electrodes adjacent in the row direction, it is possible to improve the withstand discharge performance of the resistor. Moreover, according to the present invention, it is possible to provide the image displaying apparatus which uses the light emitter substrate like this.

Further features of the present invention will become apparent from the following description of the exemplary embodiments with reference to the attached drawings.

DESCRIPTION OF THE EMBODIMENTS

Hereinafter, the exemplary embodiments of the present invention will be described with reference to the attached drawings. A light emitter substrate of the present invention can be applied to an electron beam displaying apparatus such as a CRT (Cathode Ray Tube) or an FED (Field Emission Display). Especially, since a space between an anode and a cathode becomes a state of high electrical field in the FED, high withstand discharge performance is required. Therefore, the FED is a preferable form to which the present invention is applied.

As to the embodiment of the present invention, it will be specifically described with reference to the drawings by exemplifying an image displaying apparatus of using surface conduction electron-emitting devices (SED (Surface-Conduction Electron-emitter Display) in particular among the FEDs.

Figure 1:
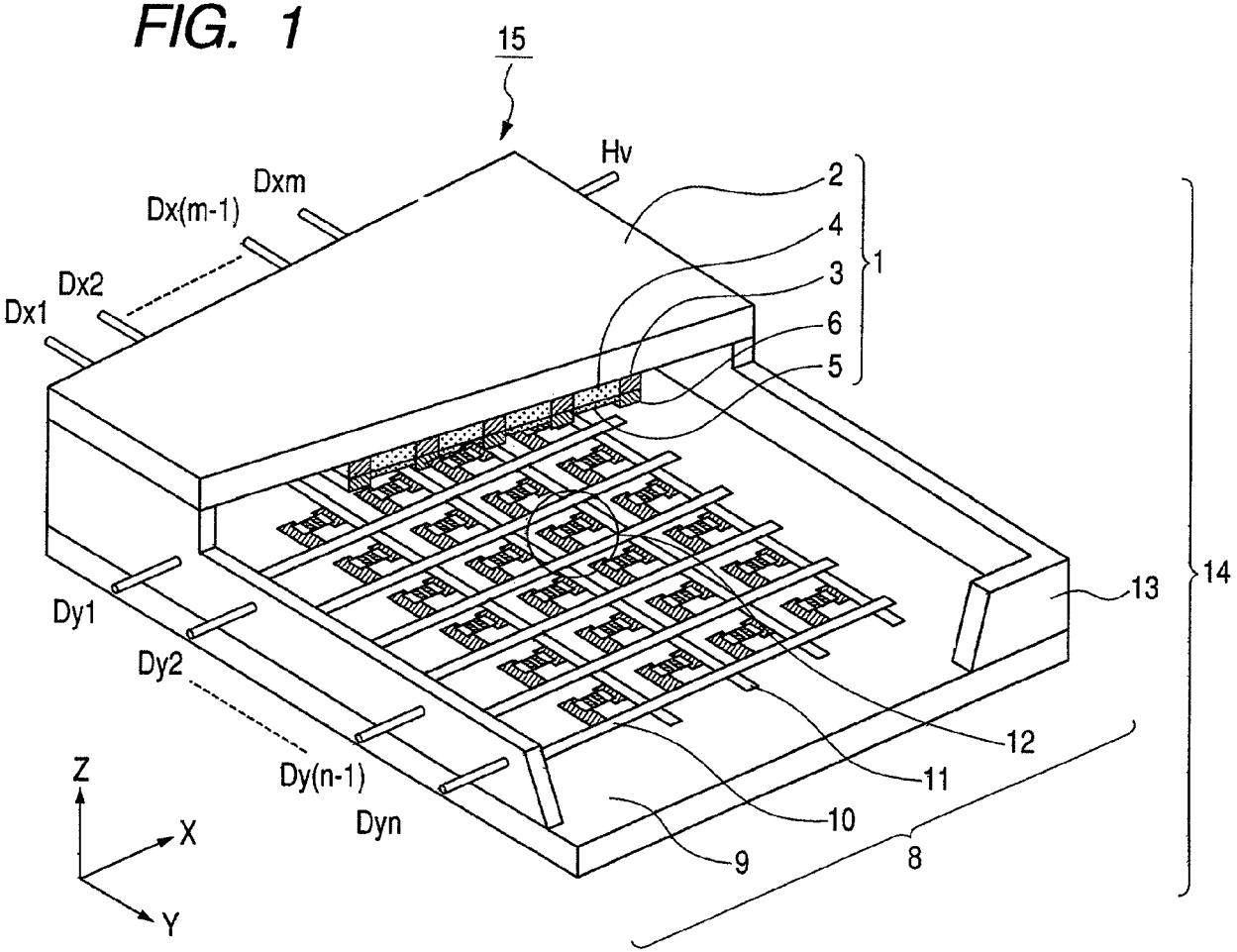
FIG. 1 is a partial fractured perspective view illustrating the basic structure of an image displaying apparatus according to an embodiment of the present invention.

FIG. 1 is a partial fractured perspective view illustrating the basic structure of an image displaying apparatus according to an embodiment of the present invention. An image displaying apparatus 15 has an electron source substrate 8, which has the two-dimensionally arranged plural surface conduction electron-emitting devices 12, and a light emitter substrate 1, which is arranged opposite to the electron source substrate 8. The light emitter substrate 1 and the electron source substrate 8 form a vacuum envelope 14 together with an outer frame 13. A spacer (not illustrated), which mutually supports the electron source substrate 8 and the light emitter substrate 1 may be provided inside the vacuum envelope 14 depending on a size of the image displaying apparatus. The image displaying apparatus 15 is constituted by adding a power supply, a driver circuit and the like, which are not illustrated, to the vacuum envelope 14.

The electron source substrate 8 has a glass substrate 9, row wirings (scanning wirings) 10 and column wirings (signal wirings) 11 formed on the glass substrate 9 and the surface conduction electron-emitting devices 12. The number of the row wirings 10 is N and the number of the column wirings 11 is M, and the N×M surface conduction electron-emitting devices 12 are formed. The N and M, which are positive integers, can be arbitrarily set in accordance with the intended number of display pixels. For example, in case of an FHD (Full High Definition) panel, the N is equal to 1080 and the M is equal to 1920×3, that is, 5760.

When referring to FIG. 1, a metal back 5 is electrically connected with a terminal Hv of the vacuum envelope 14, and a high voltage of about 1 kV to 15 kV is applied by a high voltage power supply which is not illustrated. The scanning wirings 10 and the signal wirings 11 are respectively connected with terminals Dyn (n denotes positive integers 1 to N) and terminals Dxm (m denotes positive integers 1 to M) of the vacuum envelope 14, and scanning signals and image signals are respectively given by a driver circuit which is not illustrated. The surface conduction electron-emitting devices 12 emit electrons according to the signals, and the electrons attracted by the metal back potential pass through the metal back 5 to make emit light from the phosphor of a light-emitting member 4. The luminance can be adjusted by the voltage or the signals.

Figure 2:
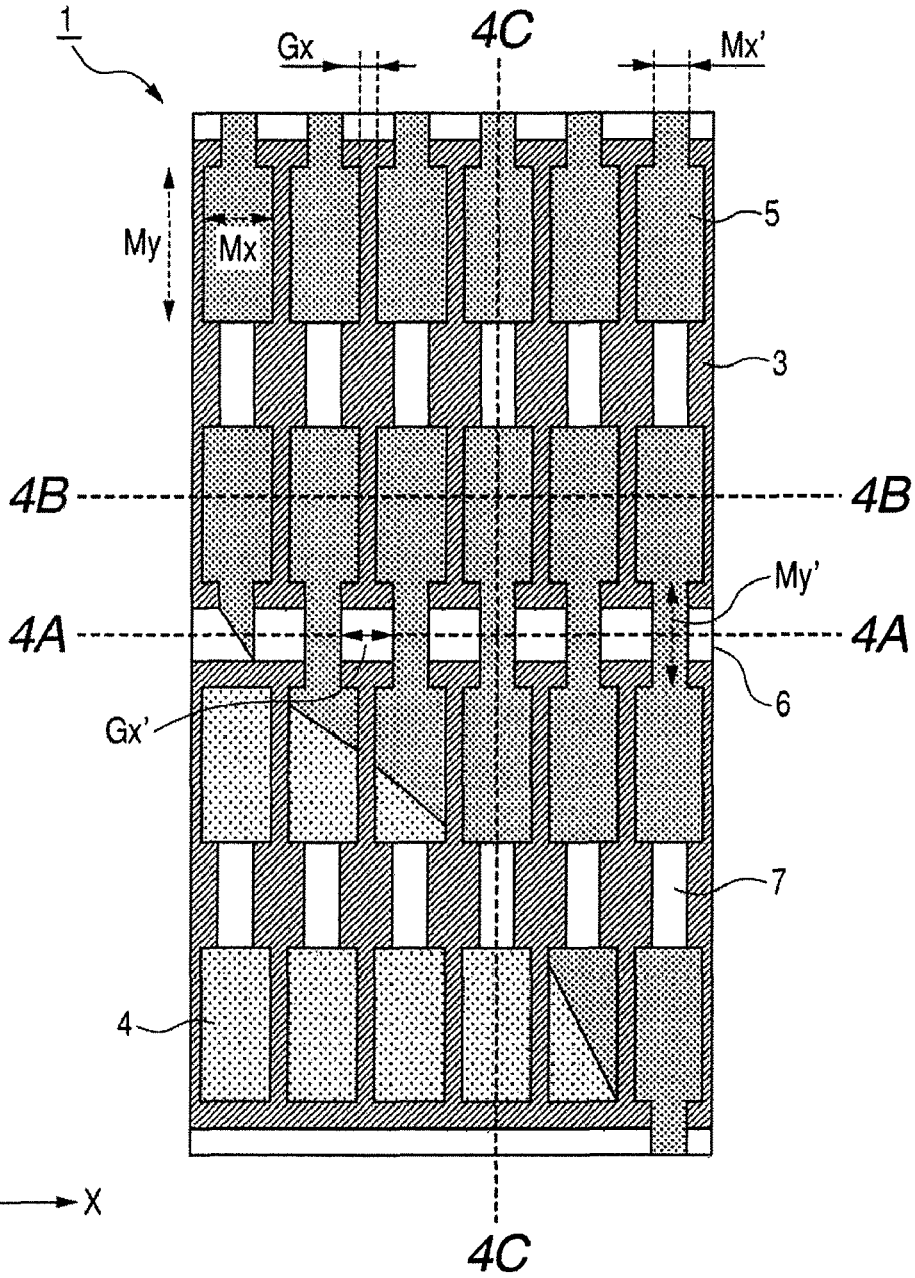
FIG. 2 is an inner face view of a light emitter substrate illustrated in FIG. 1.
Figure 3:
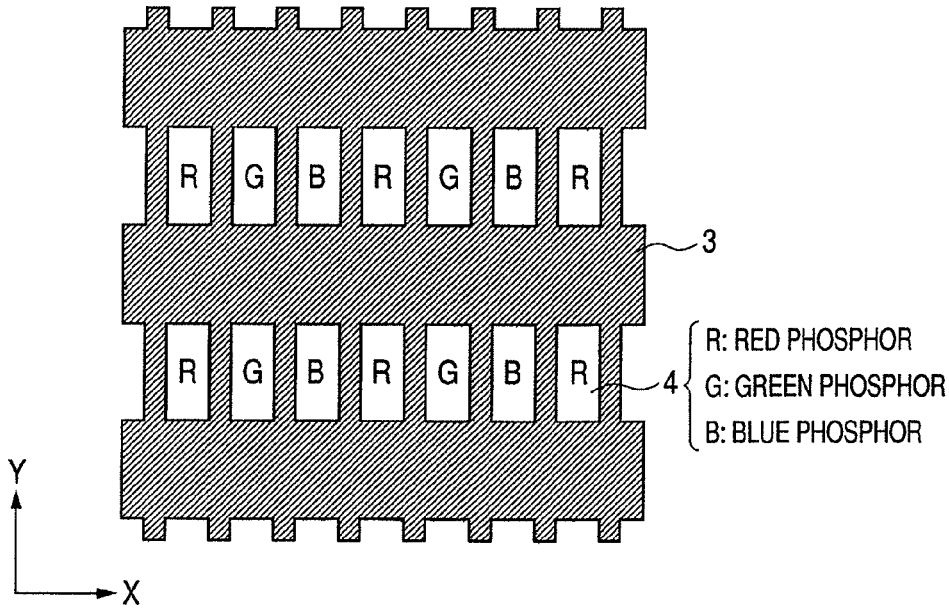
FIG. 3 is a plane view illustrating an arrangement pattern of a black member and light-emitting members in the light emitter substrate illustrated in FIG. 1.
Figure 4A:
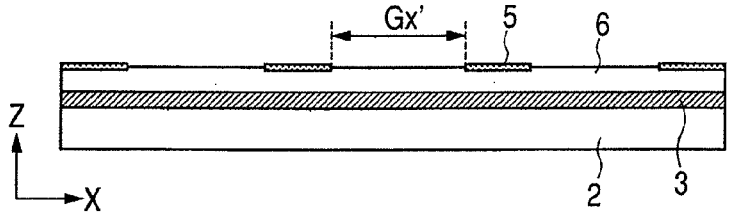
FIGS. 4A, 4B and 4C are respectively a 4A-4A cross-sectional view, a 4B-4B cross-sectional view and a 4C-4C cross-sectional view in FIG. 2.
Figure 4B:
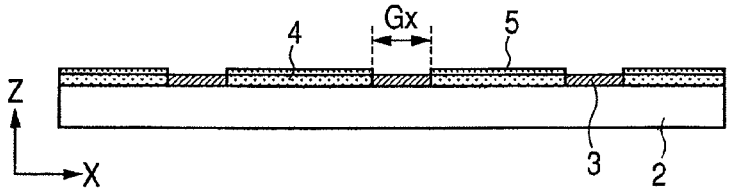
Figure 4C:
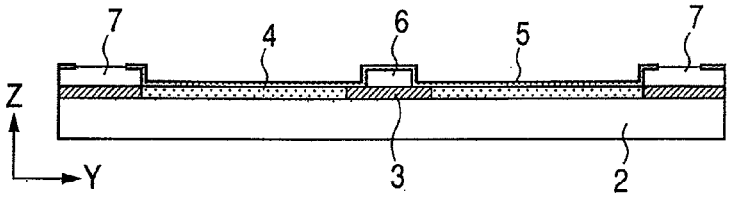

FIG. 2 is an inner face view of the above-described light emitter substrate. FIG. 3 is a plane view illustrating an arrangement pattern of a black member and light-emitting members. FIGS. 4A, 4B and 4C are respectively a 4A-4A cross-sectional view, a 4B-4B cross-sectional view and a 4C-4C cross-sectional view in FIG. 2. In FIG. 2, an illustration of the metal back is omitted in a left lower part in the drawing (an illustration, in which the metal back was stripped off, is indicated). Hereinafter, the constitution of the light emitter substrate will be described with reference to FIGS. 2, 3, 4A, 4B and 4C.

The light emitter substrate 1 has a substrate 2. It is preferable to use a glass substrate for the substrate 2 especially in a point that the vacuum performance is maintained and the intensity is ensured.

A black member 3 is provided on the substrate 2. The black member 3, which has apertures, is formed in a lattice-like shape. The light-emitting members 4 consisted of the phosphors are formed on the apertures. The light-emitting members 4 are color-coded by R (Red), G (Green) and B (Blue) in case of a color display. The color-coding pattern can be arbitrarily determined in accordance with the display characteristics and that pattern is not limited to the present embodiment. In FIG. 3, a pattern of color coding the phosphors in a striped form to the lattice-like black member is illustrated.

When referring to FIGS. 3, 4A, 4B and 4C, plural metal backs (electrodes) 5, which cover the two light-emitting members 4 which are two dimensionally arranged and adjacent to each other in the column direction (Y direction), are further provided on the substrate 2. In addition, a row-direction resistor 6 (resistance Rx) for electrically connecting the metal backs 5 adjacent to each other in the row direction (X direction) and column-direction resistors 7 (resistance Ry) for electrically connecting the metal backs 5 adjacent to each other in the column direction (Y direction) are provided on the substrate 2. As illustrated in FIG. 4A, although the row-direction resistor 6 continuously extends in the row direction (X direction), the row-direction resistors 6 may be discretely provided only between the metal backs 5 adjacent to each other in the row direction (X direction). In other words, it is allowed to be constituted that the row-direction resistor 6 is provided at least between the metal backs 5 adjacent to each other in the row direction (X direction) to serve to electrically connect the metal backs 5 adjacent to each other in the row direction (X direction). On the other hand, the column-direction resistors 7 are discretely provided only between the metal backs 5 adjacent to each other in the column direction (Y direction) as illustrated in FIG. 4C.

That is, in the light emitter substrate 1 of the present embodiment, plural light-emitting members 4 arranged in matrix on the substrate 2 are formed, and spaces between the light-emitting members 4 are partitioned by the black member 3. The row-direction resistor 6 continuously extended in the row direction (X direction) is formed on the black member 3. In addition, the column-direction resistors 7 are discretely provided in the column direction (Y direction) on the black member 3. A large number of metal backs 5, each of which covers the two light-emitting members 4, are formed on these members. Although the adjacent metal backs 5 are not directly connected each other, the metal backs are electrically connected in the row direction (X direction) and the column direction (Y direction) respectively by the row-direction resistor 6 and the column-direction resistors 7.

By the plural metal backs 5 two dimensionally arranged as described above and the resistors 6 and 7 of connecting these metal backs, even if a discharge occurs in a certain metal back, a discharge current can be reduced by preventing or absorbing the discharge occurred in other metal backs by the discharge current suppressing function of the resistors 6 and 7.

The row-direction resistor 6 is arranged on positions where the width of the metal backs 5 became a narrow state (positions indicated by a 4A-4A line illustrated in FIG. 2) to be connected with the metal backs 5. The width Mx' in the row direction at a portion of covering the row-direction resistor 6 of the metal backs 5 is narrower than the width Mx in the row direction at a position of covering the light-emitting members 4. That is, a separated distance Gx' between the metal backs 5 adjacent to each other in the row direction at a portion of connecting with the row-direction resistor 6 is longer than a separated distance Gx between the metal backs 5 in the row direction between the light-emitting members 4. By adopting such the constitution, the field intensity given to the row-direction resistor 6 due to the potential difference between the adjacent metal backs 5 generated when the discharge occurred can be weakened, and the breakdown of the row-direction resistor 6 can be prevented. In other words, when the discharge occurs between a certain metal back and an electron-emitting device, although electrons are flown in through the row-direction resistor 6 from the adjacent metal backs, a length of the row-direction resistor 6 can be easily secured by keeping the separated distance Gx' between the metal backs to become long at a connecting position of the row-direction resistor 6. Thereby, the row-direction resistor 6 can easily withstand the potential difference between the adjacent metal backs, and the anode (metal back) voltage can be more increased. Therefore, a light emitter substrate capable of displaying a high-luminance image can be obtained.

Figure 5:
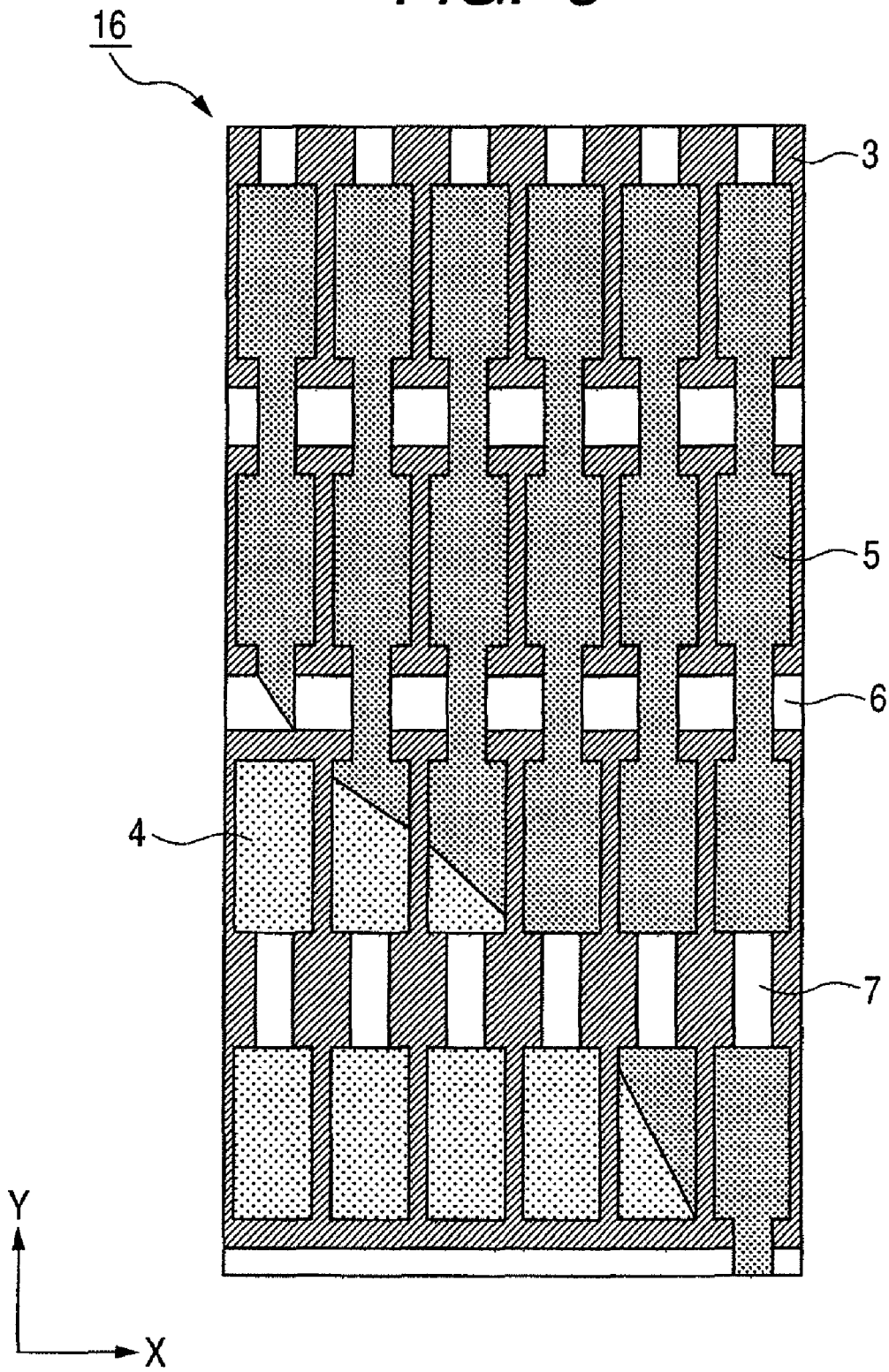
FIG. 5 is an inner face view of a light emitter substrate according to another embodiment of the present invention.

As illustrated in FIG. 5, the metal back 5 may cover the light-emitting members 4 equal to or more than three (P pieces) adjacent to each other in the Y direction. In this case, (P−1) lines of the row-direction resistors can be arranged at a maximum level corresponding to the metal backs 5, and this constitution is effective as a resistance adjusting means. Especially, since the resistance Rx can be decreased even if the volume resistance is increased, it becomes possible to increase the discharge voltage of the row-direction resistor 6 under the condition of increasing the volume resistance.

Figure 6:
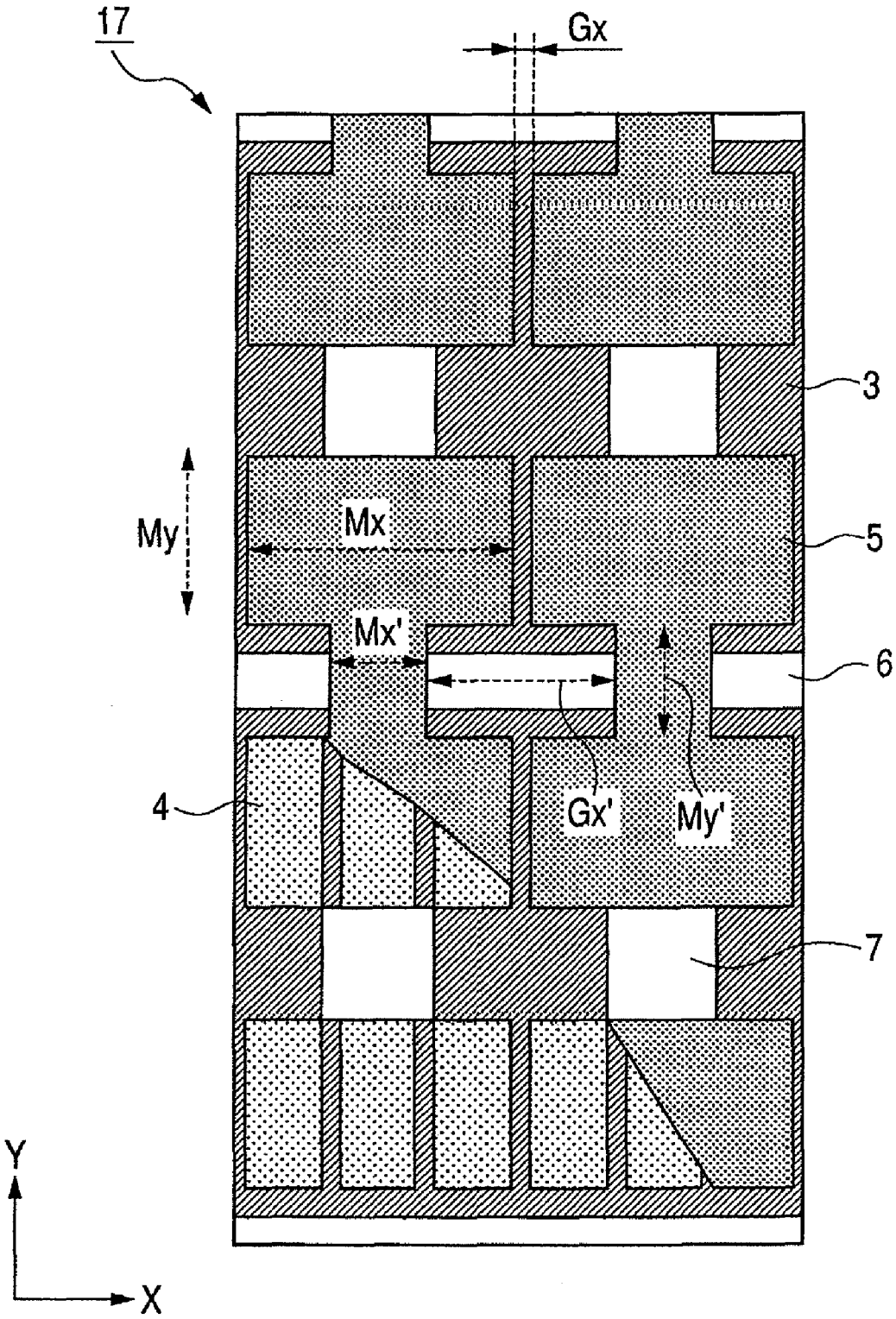
FIG. 6 is an inner face view of a light emitter substrate according to still another embodiment of the present invention.

As illustrated in FIG. 6, the metal back 5 may cover the plural light-emitting members 4 in the row direction (X direction). In this case, the width Mx' at a position of connecting with the row-direction resistor can be enormously narrowed as compared with the width Mx in the row direction (X direction) at a position of covering the light-emitting members 4. In other words, the separated distance Gx' between the metal backs adjacent to each other in the row direction at a portion of connecting with the resistor 6 can be made longer than the separated distance Gx at a position of covering the light-emitting members 4, and it is preferable to become advantageous in an aspect of the discharge voltage.

The metal backs 5 can be patterned by a masking process or an etching process by using a generally known deposition method. In particular, it is preferable to perform a mask vapor deposition method because of its simplicity.

The resistors 6 and 7 can be formed by a generally known manufacturing method such as a pattern printing method, a dispenser application method or a photolithography method. In particular, the pattern printing method is preferable from a viewpoint of accuracy and productivity.

EXAMPLES

Example 1

This example is an example of a light emitter substrate illustrated in FIGS. 2, 3, 4A, 4B and 4C. FIG. 2 is an inner face view, where a metal back of the light emitter substrate is partially cut off. The light emitter substrate of this example was manufactured as described below.

A lattice-like shape, which has apertures only on desired regions in a light emitting region, is screen printed on a surface of a cleaned glass substrate by using a black paste (NP-7803D available by Noritake Co., Ltd.), and the glass substrate is baked at the temperature 550° C. after drying it at the temperature 120° C. to form a black member 3 of which thickness is 5 μm. Pitches of aperture portions were set to become 450 μm in the Y direction and 150 μm in the X direction, which are same as those in device pitches on a rear plate, and the size of an aperture portion is set to become 220 μm in the Y direction and 90 μm in the X direction.

A high-resistance paste, in which a ruthenium oxide is contained, was printed on the black member 3 by a screen printing method such that the film thickness after the baking becomes 10 μm as the row-direction resistor 6 and the column-direction resistors 7. This paste printed on the black member was baked at the temperature 530° C. after drying it for ten minutes at the temperature 120° C. The row-direction resistors 6 were formed for all the rows every two rows on a row direction pattern of the black member 3. The column-direction resistors 7 were formed between apertures of the black member 3 of interleaving the row direction pattern every column on the row direction pattern where the row-direction resistors 6 are not arranged. In this example, the volume resistance of the high-resistance paste after the baking was set to become 2Ω·m, and the width of the row-direction resistor 6 was set to become 50 μm and the width of the column-direction resistor 7 was set to become 80 μm.

Next, a paste, in which a phosphor P22 used in a field of a CRT was dispersed, was printed on apertures of the black member 3 by the screen printing method as the light-emitting members 4. In this example, the phosphors of three colors of R, G and B are color-coded with a striped shape such that a display becomes to act as a color display. The film thickness of each phosphor was set to become 15 μm. The phosphors of three colors of R, G and B were dried at the temperature 120° C. after the printing. A drying process may be executed for each of colors or the three colors. In addition, an alkaline solution of silicic acid, that is, a water solution of including liquid glass acting as the bonding agent later was spray applied.

Next, an acrylic emulsion is applied by a spray coating method and dried to infill gaps in the phosphor powder with the acrylic resin, and an aluminum film serving as the metal back 5 was vapor deposited. In this case, a metal mask which has aperture portions on at least the portions corresponding to apertures of the black member 3 is used, and the metal backs 5 were formed on the light-emitting members 4. The thickness of aluminum was set to become 100 nm. Thereafter, the above-described resin was made to be decomposed and eliminated by heating the resin at the temperature 450° C.

The metal backs 5, which are formed from wide width portions, where the X-direction width (Mx) is 100 μm and the Y-direction width (My) is 330 μm, and narrow width portions, where the row direction width (Mx') is 50 μm and the column direction width (My') is 120 μm, were formed by an aluminum film. Note that the row-direction resistors 6 are set to be fitted into the range of the above-described narrow width portions in portions of connecting with the metal backs. Herewith, the separated distance (Gx'=100 μm) between the metal backs adjacent to each other in the row direction at portions of connecting with the row-direction resistors 6 was made to be longer than the separated distance (Gx=50 μm) between the metal backs adjacent to each other in the row direction at portions of covering the light-emitting members.

As a result, the width and length of the row-direction resistor 6 respectively become 50 μm and 100 μm, and the resistance Rx became a level of Rx=400 kΩ. And, the width and length of the column-direction resistor 7 respectively become 80 μm and 120 μm, and the resistance Ry became a level of Ry=200 kΩ.

An SED is manufactured by using a light emitter substrate 1 manufactured in this manner, and a discharge between the light emitter substrate 1 and the electron source substrate 8 was induced by ingenerating the device destruction by applying the voltage of 10 kV between the light emitter substrate 1 and the electron source substrate 8 and applying the excessive voltage to a specific device. Although about ten times of the induced discharges were performed, the light emission due to the discharge was observed only in the vicinity of the destructed device, and the light emission suggesting the breakdown of the row-direction resistors 6 or the column-direction resistors 7 was not confirmed. In addition, a discharge current was also controlled as expected. Additionally, although the damage of devices was confirmed by lighting up a whole surface with white after the discharge experiment, the damage could not be confirmed in peripheral devices other than the device purposely destructed.

Example 2

This example is different from Example 1 in a point that the metal back 5 is formed to cover the three light-emitting members 4 adjacent to each other in the column direction (Y direction) as illustrated in FIG. 5. The row-direction resistors 6 are arranged corresponding to narrow width portions of the metal backs. In addition, the column-direction resistors 7 are arranged on the rows where the row-direction resistors 6 are not arranged, that is, arranged every three rows.

As to a light emitter substrate 16 manufactured in this manner, although the resistance design is same as that in Example 1, the volume resistance of a resistant paste can be doubled, and the discharge voltage of the row-direction resistors 6 and the column-direction resistors 7 can be increased.

An SED is manufactured by using this light emitter substrate 16, and when a discharge inducing experiment similar to that in Example 1 was conducted by applying the voltage of 10 kV between the light emitter substrate 16 and the electron source substrate 8, a discharge current equivalent to that in Example 1 was observed. In addition, although the similar discharge experiment was conducted under the condition of increasing the voltage to 12 kV, the light emission due to the discharge was observed only in the vicinity of the destructed device, and the light emission suggesting the breakdown of the row-direction resistors 6 or the column-direction resistors 7 was not confirmed. In addition, a discharge current was also controlled as expected. Additionally, although the damage of devices was confirmed by lighting up a whole surface with white after a discharge experiment, the damage could not be confirmed in peripheral devices other than the device purposely destructed.

Example 3

This example is different from Example 1 in a point that the metal back 5 is formed to cover the six light-emitting members 4 in total consisted by two members adjacent to each other in the column direction and three members adjacent to each other in the row direction as illustrated in FIG. 6. The column-direction resistors 7 are arranged on the rows where the row-direction resistors 6 are not arranged, that is, one line is arranged every two columns. That is, one line is arranged between the metal backs adjacent to each other in the column direction (Y direction).

The row direction width (Mx) and the column direction width (My) at portions of covering the light-emitting members 4 of the metal backs 5 were respectively set to become 350 μm and 330 μm, and the row direction width (Mx') and the column direction width (My') on narrow width portions were respectively set to become 150 μm and 120 μm. As a result, the resistance Rx and the resistance Ry respectively became levels of Rx=1.2 MΩ and Ry=70 kΩ.

As to a light emitter substrate 17 manufactured in this manner, the separated distance (Gx) between the metal backs adjacent to each other in the row direction at portions of covering the light-emitting members was 50 μm similar to that in Example 1. However, the separated distance between the metal backs adjacent to each other in the row direction at portions of connecting with the resistors can be increased to a triple distance Gx'=300 μm as compared with a case in Example 1, and the discharge voltage can be increased by weakening the field intensity.

An SED is manufactured by using this light emitter substrate 17, and when a discharge inducing experiment similar to that in Example 1 was conducted by applying the voltage of 10 kV between the light emitter substrate 17 and the electron source substrate 8, a discharge current equivalent to that in Example 1 was observed. In addition, although the similar discharge experiment was conducted under the condition of increasing the voltage to 12 kV, the light emission due to the discharge was observed only in the vicinity of the destructed device, and the light emission suggesting the breakdown of the row-direction resistors 6 or the column-direction resistors 7 was not confirmed. In addition, a discharge current was also controlled as expected. Additionally, although the damage of devices is confirmed by lighting up a whole surface with white after a discharge experiment, the damage could not be confirmed in peripheral devices other than the device purposely destructed.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-150427, filed Jun. 9, 2008, which is hereby incorporated by reference herein in its entirety.

What is claimed is:

1. A light emitter substrate which comprises a substrate, plural light-emitting members which are positioned in matrix on the substrate, plural electrodes which are positioned in matrix, and a row-direction resistor which is positioned between the electrodes adjacent to each other in a row direction and connects these electrodes to each other, wherein each of said electrodes covers two or more of the light-emitting members, and a row-direction separated distance between the electrodes adjacent to each other in the row direction at a connecting portion between the electrodes and the row-direction resistor is larger than a row-direction separated distance between the electrodes adjacent to each other in the row direction at a portion covering the light-emitting members, a black member is provided between the two light-emitting members adjacent to each other in the column direction, and the connecting portion is positioned above the black member, wherein a width of each of said electrodes in the row direction at a portion positioned above the black member is narrower than a width of each of said electrodes in the row direction at a portion positioned above each of the two light-emitting members adjacent to each other in the column direction.

2. An image displaying apparatus comprising:

an electron source substrate having plural electron-emitting devices; and a light emitter substrate described in claim 1, wherein light-emitting members of the light emitter substrate emit light in response to electrons emitted from the electron-emitting devices, wherein a width of each of said electrodes in the row direction at a portion positioned above the black member is narrower than a width of each of said electrodes in the row direction at a portion positioned above each of the two light-emitting members adjacent to each other in the column direction.

* * * * *